US007705253B2

(12) United States Patent
Krieger et al.

(10) Patent No.: US 7,705,253 B2
(45) Date of Patent: Apr. 27, 2010

(54) APPLIANCE LOCK USING A MOTOR DRIVEN LINEAR ACTUATOR WITH HELICAL SPRING DRIVE

(75) Inventors: Jeffrey J. Krieger, Mukwonago, WI (US); Joel C. Bragg, Waterford, WI (US); James D. Spors, West Allis, WI (US); Michael K. Hintz, Waukesha, WI (US); Michael S. Osvatic, Waukesha, WI (US); Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 528 days.

(21) Appl. No.: 11/553,297

(22) Filed: Oct. 26, 2006

(65) Prior Publication Data

US 2008/0099314 A1 May 1, 2008

(51) Int. Cl.
*H01H 27/00* (2006.01)

(52) U.S. Cl. ..... 200/61.64; 200/500

(58) Field of Classification Search ..... 200/61.64, 200/329, 330, 500, 572
See application file for complete search history.

(56) References Cited

U.S. PATENT DOCUMENTS 2,910,317 A * 10/1959 Conlee ..... 292/64
3,272,935 A * 9/1966 Beller et al. ..... 200/61.7
3,627,960 A * 12/1971 Grabek ..... 200/61.64
3,638,457 A * 2/1972 Filipak ..... 68/12.26
3,763,670 A * 10/1973 Harrold ..... 68/12.06
4,312,009 A * 1/1982 Lange ..... 347/51
4,841,790 A 6/1989 Williston et al.
4,951,549 A * 8/1990 Olsen et al. ..... 91/363 R
5,345,206 A 9/1994 Morcos
2005/0005542 A1 1/2005 Prenn et al.
2007/0267791 A1 * 11/2007 Hollander et al. ..... 267/177

FOREIGN PATENT DOCUMENTS

WO WO 2006/034210 3/2006
WO WO 2006034210 A2 * 3/2006

OTHER PUBLICATIONS

PCT International Search Report, PCT/US07/082391, Mailed Jun. 4, 2008, ISA/US, Alexandria, Virginia, USA.

* cited by examiner

*Primary Examiner*—Renee S Luebke
*Assistant Examiner*—Marina Fishman
(74) *Attorney, Agent, or Firm*—Boyle Fredrickson, S.C.

(57) ABSTRACT

An electrical linear actuator employs a reversible motor driving a helical wire spring. The coils of the spring engage a follower that moves along the axis of the spring with rotation of the motor to provide linear motion. This actuator may be used as a linear drive in an appliance lock.

20 Claims, 3 Drawing Sheets

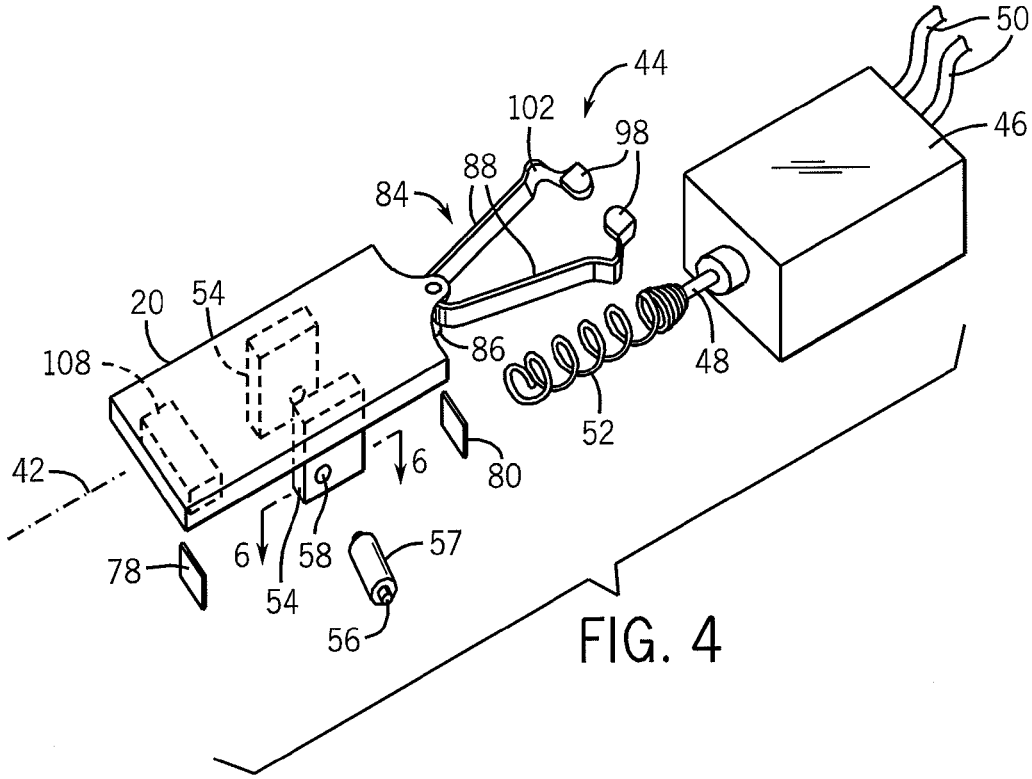
FIG. 4
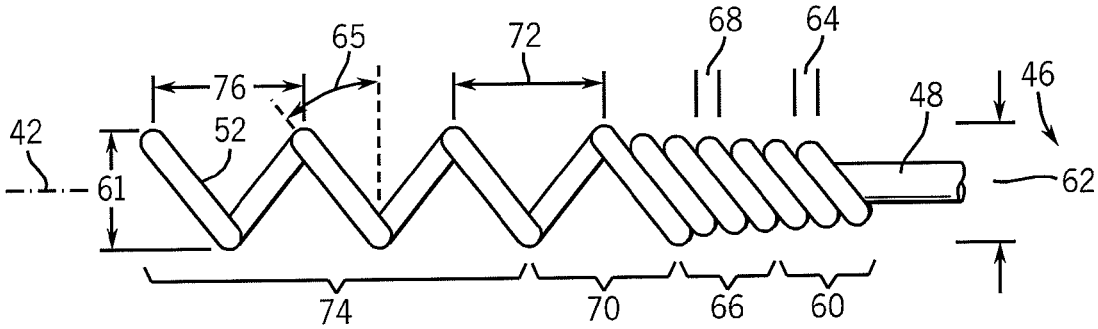
FIG. 5
FIG. 6
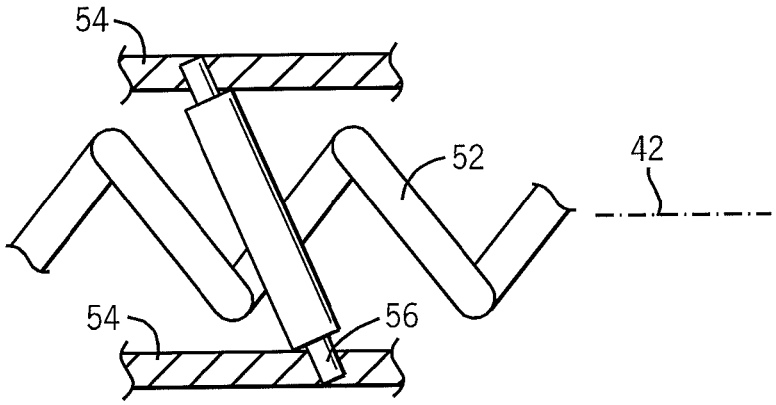

APPLIANCE LOCK USING A MOTOR DRIVEN LINEAR ACTUATOR WITH HELICAL SPRING DRIVE

CROSS-REFERENCE TO RELATED APPLICATIONS

--

STATEMENT REGARDING FEDERALLY SPONSORED RESEARCH OR DEVELOPMENT

--

BACKGROUND OF THE INVENTION

Low-cost, electric, linear actuators are used in a variety of consumer products, including home appliances and automobiles, to move various components, including lock bolts, valve plates and the like, on the occurrence of an electrical signal.

Common linear actuators include solenoids, wax motors, and DC motors driving gear trains or screw threads. In a solenoid, a metal plunger loosely surrounded by a coil of wire is moved under the influence of a magnetic field produced by an electrical current in the coil. A wax motor employs an electrical current to heat wax contained in a closed volume so that the expanding wax drives a piston out of the volume.

Conventional solenoids and wax motors use a return spring to return the plunger or piston to its unactuated state, and thus require continued power to retain their actuated state. In contrast, small DC (direct current) motors, driving a rack-and-pinion gear or screw and nut, can be reversed by changing the polarity of the driving current, avoiding the need for a return spring and allowing the actuator to retain its actuated state after power is withdrawn.

One problem with DC motor linear actuators is friction in the gear train or screw and nut, particularly when the latter become contaminated during use. The high mechanical advantage typically present in a screw and nut design can cause jamming of the screw and nut at the end of travel under the momentum of the motor.

SUMMARY OF THE INVENTION

The present invention provides an improved DC motor linear actuator in which a screw and nut are replaced by a helical wire spring and a follower. The wire helix may be given a large pitch to prevent excessive force on the follower that might lead to jamming. Further, the flexibility of the wire of the helix can cushion the shock at the end of travel. The open construction of the wire helix resists the build up of contamination that can cause excessive friction. The wire helix further lends itself to simple fabrication and attachment to a motor.

Specifically then, the present invention provides an electrical actuator having an electric motor with a motor shaft rotating about an axis. A wire helix is attached to the shaft to rotate therewith and a helix follower interfits with the wire helix to translate along a path with rotation of the wire helix.

Thus, it is an object of the invention to provide for a simple and cost-effective mechanism for converting the rotary motion of a small DC electric motor into linear motion.

The wire helix may have a lead angle of between 5 and 55 degrees.

Thus, it is an object of the invention to permit relatively large helix lead angles that reduce jamming forces while providing rapid actuation.

The wire of the helix may be sized to flex under a force of the motor when the helix follower is restrained.

It is thus another object of the invention to provide a mechanism that naturally absorbs shocks, for example, when the helix follower reaches stop points, and that readily accommodates axial misalignment.

The wire helix may provide a first portion having a first diameter engaging the helix follower, and a second portion having a second diameter conforming to the diameter of the motor shaft.

Thus, it is an object of the invention to provide a simple means of attaching the helix to the shaft by using helical coils of the wire.

The wire helix may provide a first portion with a lead angle and a second portion with a second lead angle, the first and second portions at different times engaging the helix follower.

Thus it is an object of the invention to provide a simple method of changing the lead angle of the helix, and thus the relative mechanical advantage between the helix and the follower over the length of the helix, such as may be used to change the actuation force, for example, near the ends of motion of the helix follower to prevent jamming.

The second portion may be between the motor shaft and the first portion, and the second lead angle may be larger than the first lead angle.

Thus, it is an object of the invention to provide for a decrease in actuation force when the helix follower is closest to the motor where the helix itself cannot serve, through its elasticity, to cushion the forces generated when the helix follower confronts a stop.

The helix follower may be a bar fitting within the coils of the helix.

Thus it is an object of the invention to provide a simple follower suitable for a wire helix and resistant to jamming.

The helix follower may contact only one side of the helix.

It is thus another object of the invention to provide a helix follower that can decouple from the helix, upon direction reversal, to decrease the load on the motor during its startup.

The helix follower may contact the helix at only a single point.

It is thus another object of the invention to provide a small contact area between the helix follower and the helix that resists capture of contamination.

The helix may be a non-magnetic stainless steel.

It is thus another object of the invention to provide an actuator that is corrosion resistant, durable and which does not divert magnetic flux.

The motor may be a permanent magnet DC motor.

It is thus another object of the invention to provide a simple actuation mechanism that may be used with small motors.

The helix follower may be attached to a switch throw, which may, for example, be a sliding conductive element moving along an axis of the wire helix with the rotation of the helical wire, and pressing outward perpendicularly to the axis of the helical wire against opposed poles.

It is thus an object of the invention to provide a signal indicating the motion of the actuator and to provide a switch compatible with the present system that does not exert a torque on the follower, such as would require friction-increasing stabilization of the helical coil or follower.

The switch throw may be a V-shaped metal spring contacting the poles at the ends of the V.

It is thus another object of the invention to provide a simple throw mechanism that provides balanced outward forces.

The linear electrical actuator may be employed in an appliance latch where the helix follower attaches to a bolt that may extend from one of the housing or a door of the appliance to engage a strike placed on the other of the housing or door.

Thus, it is an object of the invention to provide a low cost latch mechanism suitable for use in appliances that provides for rapid engagement and disengagement and which is stable in engagement and disengagement without the application of electrical power (to reduce electrical consumption), and yet may be readily reversed simply by reversal of power to the motor. These particular objects and advantages may apply to only some embodiments falling within the claims, and thus do not define the scope of the invention.

BRIEF DESCRIPTION OF THE DRAWINGS

FIG. 4 is an exploded view of an electrical actuator used in the latch of FIGS. 1-3 showing a DC motor that may turn a helical wire spring engaged by a helix follower bar held below the bolt of the latch;

FIG. 5 is a top plan view of the wire helix and shaft of the motor of FIG. 4 showing changes in pitch and diameter of the wire helix such as changes the lead angle;

FIG. 6 is a cross-section along line 6-6 of FIG. 4 showing the orientation of the bar of the helix follower as it engages the helix at a single point on a single side of the helix;

DETAILED DESCRIPTION OF THE PREFERRED EMBODIMENT

Figure 1:
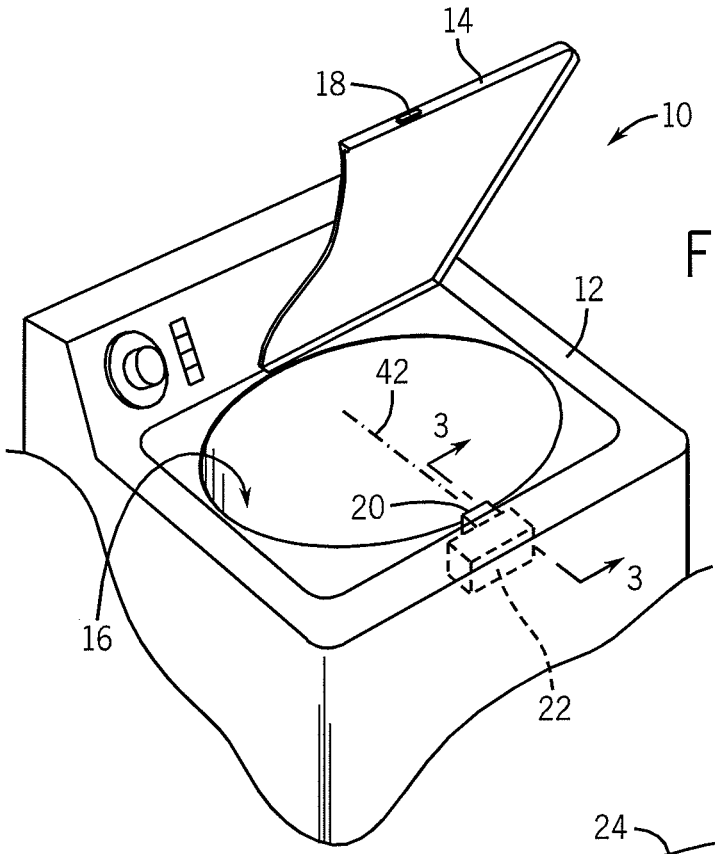
FIG. 1 is a fragmentary perspective view of a washing machine showing the positioning of a latch employing the present invention, such as may extend a bolt to engage a strike in the edge of a door.

Referring now to FIG. 1, an appliance 10, such as a washing machine, may have a housing 12 having an opening over which a hinged door 14 may close, for example, to cover a wash basket 16. The door 14 may be locked when closed to prevent injury to a user during the spin cycle of the washing machine. For this purpose, a front edge of the door 14 may include a strike aperture 18, which may receive a bolt 20 when the door 14 is in the closed position. The bolt 20 may extend from a latch mechanism 22 positioned within the housing 12 under the control of an electrical signal. As used herein, the term "bolt" may embrace any similar locking element such as a hook, pin, latch bar, shaft or the like.

Figure 2:
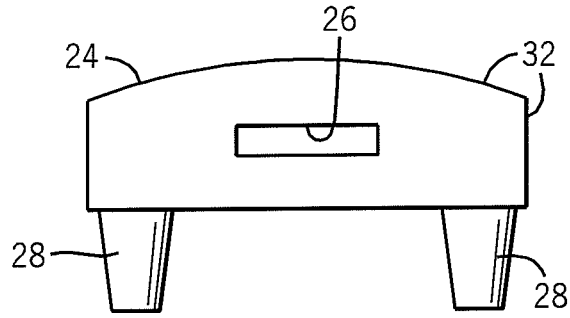
FIG. 2 is a front elevational view of a bezel that may serve to attach the latch of FIG. 1 to the housing of the washing machine.
Figure 3:
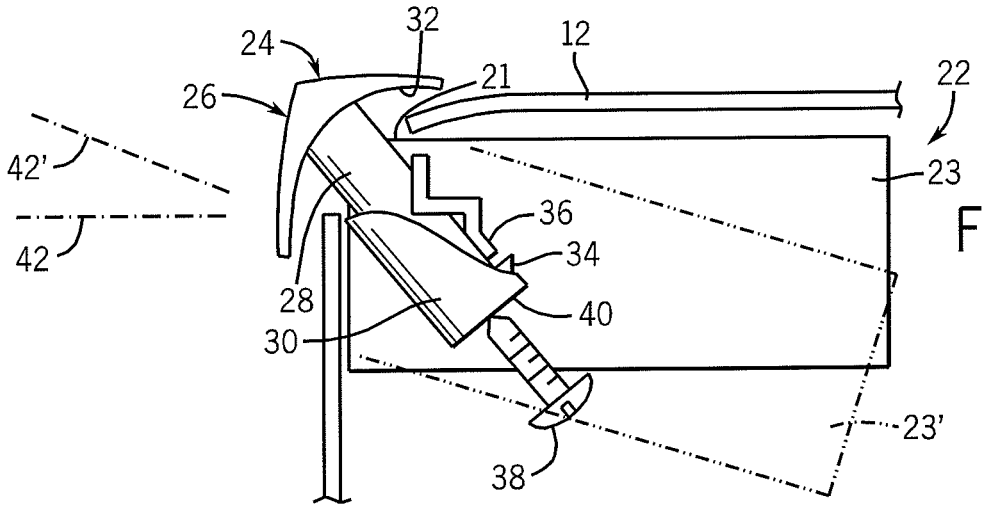
FIG. 3 is a cross-sectional view taken along line 3-3 of FIG. 1 showing the latch of FIG. 1 as held by the bezel, and showing tipping of the latch prior to a final installation using screws, such as causes blocking of the bolt that may be detected to signal incomplete installation of the latch.

Referring now to FIGS. 2 and 3, the latch mechanism 22 may be positioned within the housing 12 behind an aperture 21 through which the bolt 20 (not shown in FIG. 3) may extend. The latch mechanism 22 may be held in position by means of a bezel 24 having a central aperture 26 aligning with aperture 21 and a pair of rearwardly extending posts 28. The posts 28 that may pass through corresponding apertures (not shown) in the housing 12 to be received by sockets 30 molded in the side of the latch housing 23.

The rearwardly extending posts 28 include upwardly extending teeth 34 that may engage a lip 36 of the socket 30 holding the bezel 24 and housing 23 loosely engaged so as to prevent the housing 23 from dropping downward free of the bezel 24 during assembly. When the posts 28 are received by the socket 30, screws 38 may be inserted through bases 40 of the sockets 30 to engage threadable portions of the posts 28.

Tightening of the screws 38 draws the bezel 24 tightly down against the housing 12 and to pull the latch housing 23 upward against the inner surface of the housing 12. When so tightened, the bolt within the latch housing 23 will extend along a bolt axis 42 that is generally horizontal to be received by the strike aperture 18 of the door 14 when the door 14 is closed. Prior to this tightening, however, gravity will pull the latch housing 23 downward, as shown by a dashed outline of latch housing 23', causing the bolt axis 42' to tip upward. This misalignment will prevent the bolt from fitting into the strike aperture 18. Blockage of the bolt can be detected by a switch attached to the bolt, as will be described below, providing an error signal to a controller within the appliance 10 indicating a problem with the assembly of the latch housing 23.

Aperture 26 of the bezel 24 is surrounded by a rearwardly concave and flexible skirt 32 having a curvature with a radius slightly smaller than the radius of curvature of the housing 12 beneath the bezel 24. Thus, when the bezel 24 is pulled tightly against the housing 12 with the screws 38, the skirt 32 flexes outward forming a tight seal with the surface of the housing 12. The housing 23 and bezel 24 are constructed of a flexible thermoplastic material that also provides for electrical insulation and that freely passes magnetic flux.

Referring now to FIG. 4, the bolt 20 may be driven by and form part of a linear actuator 44 comprising a permanent magnet DC motor 46 having a shaft 48 that may rotate in one of two directions according to the polarity of electrical voltage applied to the motor 46 over motor leads 50. Attached to the shaft 48 and axially aligned therewith is a wire helix 52, both of which are generally parallel to the bolt axis 42.

Paddles 54, extending downward from the bolt 20, flank the left and right side of the wire helix 52 and receive a transversely extending metal bar 56 passing through corresponding holes 58 in each of the paddles 54 to intersect the wire helix 52 and to be held captive by its coils. The paddles 54 and bar 56 provide a helix follower that moves along the axis 42 with rotation of the wire helix 52.

The wire helix 52 is preferably a spiral of spring-tempered stainless steel wire following a three-dimensional curve that lies on a cylinder of a defined diameter and having a central axis parallel to axis 42. The wire of the wire helix 52 will have a defined angle with respect to a plane perpendicular to the axis 42 termed its lead angle. The lead angle may be controlled simply by spacing between wire coils along the axis of the wire helix 52.

Referring now to FIG. 5, the wire helix 52 provides a number of different pitches and diameters and thus different lead angles, where lead angle 65, as described above, is the angle between a plane orthogonal to the axis 42 and the wire of the helix 52. For a given helix diameter, the lead angle will increase as the pitch increases. In a first region 60, near where the wire helix 52 is attached to the motor shaft 48, the wire helix 52 is given a small diameter 62 so that it may be press fit and welded directly to the shaft 48. The pitch 64 in this first region 60 is such that the windings of the wire helix 52 abut each other and thus is approximately equal to the diameter of the wire of the wire helix 52. Here the lead angle may be relatively low.

In a second region 66, displaced from the motor 46 by region 66, the diameter 61 of the wire helix 52 increases, while the pitch 68 is retained at pitch 64 for the purpose of stable transition.

In a next region 70 proceeding outward from the motor 46, the pitch is abruptly increased to an expanded pitch 72 (increasing the lead angle) and then, at succeeding region 74 encompassing the remainder of the wire helix 52, the pitch decreases slightly to a reduced pitch 76 (and reduced lead angle), both lead angles being typically greater than five degrees and less than fifty-five degrees. These regions 70 and 74 provide drive surfaces for the helix follower of the bar 56 and create a relatively large opening between coils of the wire helix 52 such as to resist entrapment of contaminants.

Referring also to FIG. 4, when the bolt 20 is fully extended and the bar 56 is in the region 74, the bolt 20 may hit a stop 78. A PTC thermister (not shown) may be placed in series with the motor to prevent over-current of the motor 46 when the motor 46 stalls, but even with current limiting, the interaction of the bolt 20 with the stop 78 can produce a relatively high instantaneous torque (and resulting actuation force) caused by the rapid deceleration of rotating mass of the motor 46. However, any jamming of the bar 56 and wire helix 52, such as might prevent reversal of the wire helix 52, is forestalled by the natural compliance of the wire helix 52, which compresses slightly to slow the deceleration of the motor 46 decreasing the peak torque.

When the motor 46 is reversed and the bolt 20 is drawn inward against a second stop 80 adjacent to the motor 46, there is less length of the wire helix 52 to act as a spring to slow the deceleration of the motor 46. In this case, the increased lead angle of the wire helix 52 in region 70, serves to reduce the axial force and to prevent jamming.

Referring now to FIG. 6, the bar 56 of the helix follower may be installed at an angle with respect to the axis 42 to contact the coils of the wire helix 52 at a single point only, thus reducing potential entrapment of contaminants. Further, the angle of the bar 56 is such that the bar 56, at any time, contacts only one side of the wire helix 52. This allows the load of the bolt 20 to be decoupled from the wire helix 52 upon change in direction of the motor 46, preventing stalling of the starting motor 46 in a position of low torque. This decoupling also allows the motor to start up in a reversed direction with reduced load to gain speed before the bar 52 recontacts the side of the wire helix 52. The bar 56 may be molded into paddles 54 or may be a metal bar held by the paddles providing improved wear resistance. In one embodiment, shown in FIG. 4, the bar 56 may be surrounded with a sleeve 57 (for example a self-lubricating plastic material) that provides a lower-friction contact between the bar 56 and the helix 54 by action of the sleeve 57 rolling about the bar 57.

Figure 7:
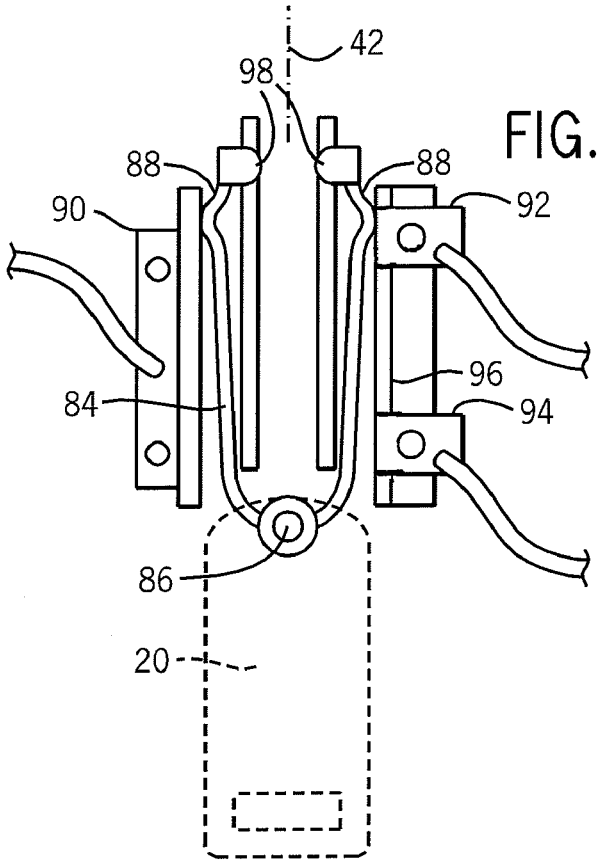
FIG. 7 is a top plan view of a switch having a V-shaped throw compressed between opposing poles of the switch and attached to the bolt of FIG. 4.
Figure 8:
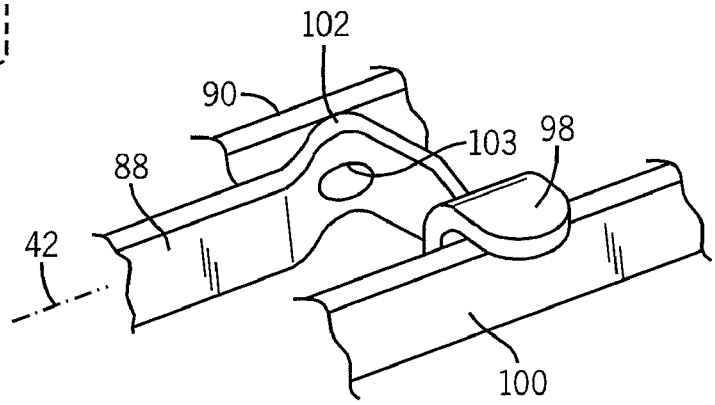
FIG. 8 is a detailed fragmentary perspective view of one arm of the V-shaped throw showing a bifurcation of the contact surface and a supporting slider tip.

Referring now to FIGS. 4 and 7, extending axially rearward from the bolt 20, is a metallic V-shaped throw 84. The throw 84 has outwardly diverging arms 88 that are flexible and compressed between opposed surfaces of pole 90 on one side, and pole 92 or 94 on the opposite side as the bolt 20 and throw 84 move axially throughout the length of travel of the bolt 20. The pole 90 is continuous while pole 92 and 94 occupy opposite axial ends of a track 96. Electrical continuity exists from the pole 90 through spring throw 84 to pole 92 when the bolt 20 is fully retracted and from the pole 90 through spring throw 84 to pole 94 when the bolt 20 is fully extended. Electrical continuity is broken when the bolt 20 is neither fully retracted nor fully extended. In this way, three distinct signals may be generated, one each for when the bolt is fully extended, fully retracted and in transition. Referring now also to FIG. 8, an outwardly convex dimple 102 may be placed at the ends of the arms 88 where they ride against the poles 90, 92, or 94 (only pole 90 is shown), to provide a contact surface. The dimple 102 may include an axial groove, 103 bifurcating the surface of the contact where it connects with one of the poles 90, 92, or 94 to provide improved contact reliability.

The vertex of the V-shaped throw 84 is pivotally attached to a downwardly extending pivot pin 86 on the bolt 20 so that the throw 84 is self-aligning between pole 90 and pole 92 and 94 on track 96. Referring now also to FIG. 8, inwardly extending tabs 98 are formed on the ends of the arms 88 to ride on tracks 100 positioned between the ends of the arms 88. The tabs 98 help stably locate the ends of the arms 88 against rotational movement. It will be understood from this description that there is no rotational torque exerted by the V-shaped throw 84 on the bolt during switching action such as might tend to cam the bolt 20 or divert the wire helix 52 off axis.

Figure 9:
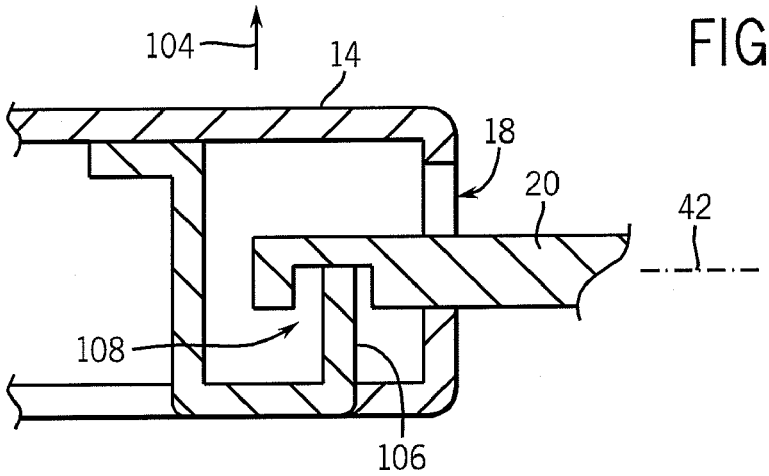
FIG. 9 is a fragmentary cross-section taken along line 3-3 of FIG. 1 when the washing machine door is closed showing engagement of the bolt in a strike hole of the door to receive an upwardly extending tooth in the door locking the bolt when the door is lifted during engagement.

Referring now to FIGS. 1 and 9, when the bolt 20 is inserted through the strike aperture 18 in the door 14 and the door 14 is lifted upward, as indicated by arrow 104, a tooth 106 formed in the door 14 behind the strike aperture 18 may engage a corresponding socket 108 formed in the lower side of the bolt 20. The interengagement of the tooth 106 and socket 108 prevents force on the door 14 possibly sufficient to bend the bolt 20, or from disengaging the bolt 20 from the strike aperture 18.

It is specifically intended that the present invention not be limited to the embodiments and illustrations contained herein, but include modified forms of those embodiments, including portions of the embodiments and combinations of elements of different embodiments as come within the scope of the following claims.

We claim:

1. An electrical actuator comprising:

an electric motor providing a motor shaft rotating about an axis;

a wire helix attached to the shaft to rotate therewith; and a helix follower having a portion interfitting with the wire helix and fitting between axially adjacent coils of the wire helix to translate along the axis with rotation of the wire helix as driven by a sliding engagement of the wire helix acting on the helix follower as a screw thread, the engagement between the helix follower and the wire helix being the sole mechanism for translating the helix follower with rotation of the wire helix; and a first and second stop positioned along the axis to stop travel of the helix follower as driven by the wire helix at the stops.

2. The electrical actuator of claim 1 wherein the wire helix provides a lead angle that is greater than 5 degrees.

3. The electrical actuator of claim 1 wherein the wire of the wire helix is sized to flex under a force of the motor when the helix follower is restrained.

4. The electrical actuator of claim 1 wherein the wire helix simultaneously provides a first portion having a first helix diameter engaging the helix follower and a second portion having a second helix diameter different from the first diameter and conforming to a diameter of the motor shaft.

5. The electrical actuator of claim 1 wherein the wire helix simultaneously provides a first portion with a first pitch in a relaxed state engaging the helix follower and a second portion with a second pitch in the relaxed state different from the first pitch also engaging the helix follower.

6. The electrical actuator of claim 1 wherein the helix follower is a bar fitting within coils of the wire helix.

7. The electrical actuator of claim 1 wherein the helix follower fits within an axial gap between adjacent coils of the wire helix to permit axial movement of the helix follower in a gap between adjacent coils of the wire helix, the movement within the gap possible without rotation or compression of the wire helix.

8. The electrical actuator of claim 1 wherein the wire helix is a non-magnetic stainless steel.

9. The electrical actuator of claim 1 wherein the motor is a permanent magnet DC motor.

10. The electrical actuator of claim 1 wherein the follower is attached to a switch throw.

11. The electrical actuator of claim 10 wherein the switch throw is a sliding conductive element moving along an axis of the wire helix with rotation of the wire helix and pressing outward perpendicularly to the axis of the wire helix against opposed poles.

12. The electrical actuator of claim 11 wherein the switch throw is a V-shaped metal spring contacting the poles at ends of the V.

13. The electric actuator of claim 1 further including:

(a) a strike attached to one of a door and housing of a home appliance having a door opening and closing against a housing;

(b) a bolt assembly attached the other of the door and housing and to the helix follower to engage a door of the home appliance when the door is in a closed position and the electric motor is moved in a first direction to retain the door in the closed position and to disengage with the door of the home appliance when the electric motor is moved in the second direction.

14. The electrical actuator of claim 13 wherein the bolt includes a recessed portion engaging a tooth in the strike aperture to lock the bolt against retraction when an opening force is applied to the door with the bolt engaged with the strike.

15. The electrical actuator of claim 13 further including a switch and wherein the helix follower communicates with a movable contact of the switch to move the movable contract to activate the switch with movement of the helix follower providing a signal from the switch when the bolt is extended.

16. The electrical actuator of claim 13 further including a switch and wherein the helix follower communicates with a movable contact of the switch to move the movable contract to activate the switch with movement of the helix follower, the switch providing at least two distinct signals indicating, respectively, when the bolt is retracted, when the bolt is extended and neither retracted nor extended.

17. The electrical actuator of claim 13 further including a bezel having an aperture sized to admit the bolt, the aperture surrounded by a flexible skirt, the bezel further including an attachment means for drawing the bezel against the bolt assembly on either side of a wall of the appliance, whereby the skirt is compressed against the wall of the appliance to seal there against.

18. The electrical actuator of claim 16 wherein the attachment means includes a snap fitting holding the bezel and lock assembly together on either side of the wall, and a screw fitting tightening the bezel and lock assembly together.

19. The electrical actuator of claim 17 wherein the snap fitting allows misalignment of the lock assembly and bolt, thus preventing extension of the bolt to engage the door of the appliance when the door is closed.

20. An electrical actuator comprising:

an electric motor providing a motor shaft rotating about an axis;

a wire helix attached to the shaft to rotate therewith; and a helix follower interfitting with the wire helix to translate along the axis with rotation of the wire helix as driven by the wire helix acting on the helix follower as a screw thread; and wherein the wire helix provides a first portion with a first pitch engaging the helix follower and a second portion with a second pitch engaging the helix follower, the second portion being between the motor shaft and the first portion wherein the second pitch is greater than the first pitch.

* * * * *